US006553189B2

(12) United States Patent
Miyamoto et al.

(10) Patent No.: US 6,553,189 B2
(45) Date of Patent: Apr. 22, 2003

(54) OPTICAL GUIDE, PROCESS CARTRIDGE, AND ELECTROPHOTOGRAPHIC IMAGE FORMING APPARATUS

(75) Inventors: Jun Miyamoto, Shizuoka (JP); Tadashi Horikawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/972,993

(22) Filed: Oct. 10, 2001

(65) Prior Publication Data

US 2002/0061196 A1 May 23, 2002

(30) Foreign Application Priority Data

Oct. 12, 2000 (JP) ..... 2000-311671

(51) Int. Cl.[7] ..... G03G 15/08
(52) U.S. Cl. ..... 399/27; 399/64; 399/254
(58) Field of Search ..... 399/27, 30, 58, 399/61, 62, 64, 111, 119, 120, 254, 258; 222/DIG. 1

(56) References Cited

U.S. PATENT DOCUMENTS

| | | | | |
|---|---|---|---|---|
| 5,946,531 A | | 8/1999 | Miura et al. | 399/111 |
| 6,002,896 A | | 12/1999 | Miyamoto et al. | 399/114 |
| 6,055,406 A | | 4/2000 | Kawai et al. | 399/360 |
| 6,061,538 A | | 5/2000 | Arimitsu et al. | 399/111 |
| 6,167,219 A | | 12/2000 | Miyamoto et al. | 399/90 |
| 6,173,130 B1 | * | 1/2001 | Oguma | 399/27 |
| 6,282,390 B1 | | 8/2001 | Miyabe et al. | 399/111 |
| 6,336,017 B1 | | 1/2002 | Miyamoto et al. | 399/116 |
| 6,377,760 B1 | * | 4/2002 | Hagiwara | 399/30 |

OTHER PUBLICATIONS

U.S. application Ser. No. 09/710,862, Tadashi Horikawa et al., filed Jan. 14, 2000.
U.S. application Ser. No. 09/796,457, Koji Miura, et al., filed Mar. 2, 2001.

* cited by examiner

*Primary Examiner*—Hoang Ngo
(74) *Attorney, Agent, or Firm*—Fitzpatrick, Cella, Harper & Scinto

(57) ABSTRACT

An optical guide to be used for detecting the remaining amount of developer contained in a developer containing portion includes a blocking portion for blocking an opening formed in the developer containing portion when the optical guide is fitted to the developer containing portion, an optical guide portion for guiding light, which is formed on a side to be positioned on the outside of the developer containing portion with respect to the blocking portion when the optical guide is fitted to the developer containing portion, an outside inclining surface inclining toward the side, on which the optical guide portion is formed, with respect to the blocking portion, the outside inclining surface being formed at an end portion of the optical guide portion on the blocking portion side in a lengthwise direction of the optical guide portion, and an inside inclining surface portion inclining toward a direction intersecting the lengthwise direction of the optical guide portion, the inside inclining surface portion being formed on a side to be positioned on an inside of the developer containing portion with respect to the blocking portion when the optical guide is fitted to the developer containing portion, wherein the optical guide is formed into one united body with a light-transmissive material.

14 Claims, 12 Drawing Sheets

OPTICAL GUIDE, PROCESS CARTRIDGE, AND ELECTROPHOTOGRAPHIC IMAGE FORMING APPARATUS

BACKGROUND OF THE INVENTION

1. Field of the Invention

The present invention relates to an electrophotographic image forming apparatus, a process cartridge that is detachably mountable to the main body of the apparatus, and an optical guide for detecting the developer amount of the developer-containing portion of the apparatus.

Now, the electrophotographic image forming apparatus is an apparatus for forming an image on a recording medium by the use of an electrophotographic image forming process. As examples of the apparatus, an electrophotographic copying machine, an electrophotographic printer (e.g. a laser beam printer, an LED printer, and the like), a facsimile machine, a word processor and the like can be cited.

Moreover, a process cartridge may be a cartridge into which charging means, developing means or cleaning means, and an electrophotographic photosensitive drum are integrally incorporated, and which is detachably mountable to the main body of the electrophotographic image forming apparatus. Alternatively, the process cartridge may be a cartridge into which the electrophotographic photosensitive drum and at least one of the charging means, the developing means and the cleaning means are integrally incorporated, and which is detachably mountable to the main body of the electrophotographic image forming apparatus. Further alternatively, the process cartridge may be a cartridge into which the electrophotographic photosensitive drum and at least the developing means are integrally incorporated, and which is detachably mountable to the main body of the electrophotographic image forming apparatus.

2. Description of the Related Art

An image forming apparatus such as a printer using an electrophotographic process records an image as follows. That is, first, a photosensitive drum being an image-bearing member is uniformly charged. The photosensitive drum is selectively exposed to light, thereby forming a latent image. The latent image is visualized with toner, which is developer. The visualized toner image is transferred to a recording medium. Moreover, by the application of heat or pressure on the transferred toner image, the toner image is fixed on the recording medium. Thus, the image is recorded.

Such an apparatus needs the supply of toner and maintenance of various kinds of process means. However, a cartridge equipped with a photosensitive drum, charging means, developing means, cleaning means and the like integrally therein is put to practical use as a measure for simplifying the toner supplying work and the maintenance.

A developing device of such a process cartridge is equipped with a developer-remaining-amount detecting device for detecting a remaining amount of the stored developer. The developer-remaining-amount detecting device is realized in conformity with various modes. A mode cheaper in cost and simpler in structure is one adopting light-transmission-type remaining-amount detection. The light-transmission-type remaining-amount detection is a mode such that detection light passes through a container containing developer therein for the detection of the remaining amount of the developer contained in the container on the basis of the passing time of the detection light.

A description will be given to the detailed structure of the light-transmission-type remaining-amount detection device in the following. As shown in FIG. 12, detection light emitted by a light-emitting member such as a light-emitting device passes through a first guide portion 31*a* made of a light-transmissive member, and then the detection light enters the inside of a developer container 25 from a first window member 26*a* that is formed on the wall surface of the developer container 25 and has a light-transmissive property. Moreover, the detection light that has entered in the developer container 25 passes through the developer container 25 to the outside of the developer container 25 through a second window member 26*b* that is formed on the wall surface of the developer container 25 and has a light-transmissive property. The detection light that has passed through to the outside of the developer container 25 reaches a light-receiving member such as a light-receiving element through a second guide portion 31*b* made of a light-transmissive member. The developer-remaining amount in the developer container 25 is detected on the basis of the period of time when the light-receiving member received the detection light. Incidentally, the technology shown in FIG. 12 is not a prior art. The configuration shown in FIG. 12 is earlier technology that was considered in the process of the development of the present invention.

In the above earlier technology, in each of the first and the second guide portions 31*a* and 31*b*, both being a light-transmissive member, the light-emitting member or the light-receiving member is disposed at one end thereof and an incidence plane or an exit plane is disposed at the other end in the vicinity of the first or the second window member 26*a* or 26*b*. Consequently, when the window member 26*a* or 26*b* or the incidence or exit plane opposed to the window member 26*a* or 26*b* becomes dirty, a light-transmission loss increases. Moreover, because the media between the incidence plane or the exit plane of the optical guide portion 31*a* or 31*b* and the window member 26*a* or 26*b* are different from each other, a diffused light phenomenon and reflection occur at the boundaries between the different media. This phenomenon also causes the loss of light.

Moreover, because the optical guide portions 31*a* and 31*b* are made from acrylic resin and, on the other hand, the container of the process cartridge is made from polystyrene, it is impossible to perform hot welding or ultrasonic welding of the optical guide portions 31*a* and 31*b* to the container. Accordingly, the optical guide portions 31*a* and 31*b* are fixed to the container with fixing means mechanically. Consequently, many parts are needed for the detection of the amount of remaining developer as the optical guide portions 31*a* and 31*b*, the window members 26*a* and 26*b*, and the fixing means. Moreover, because each part is small in size, the fixing of them requires a lot of care.

Besides, a space is needed to dispose the fixing means.

SUMMARY OF THE INVENTION

An object of the invention is to provide an optical guide having less loss of light , a process cartridge using the optical guide, and an electrophotographic image forming apparatus capable of mounting the process cartridge detachably.

Another object of the invention is to provide an optical guide easy to fit, a process cartridge using the optical guide, and an electrophotographic image forming apparatus capable of mounting the process cartridge detachably.

A further object of the invention is to provide an optical guide capable of decreasing the number of its parts, a process cartridge using the optical guide, and an electrophotographic image forming apparatus capable of mounting the process cartridge detachably.

A still further object of the invention is to provide an optical guide that needs less space for fitting, a process cartridge using the optical guide, and an electrophotographic image forming apparatus capable of mounting the process cartridge detachably.

A still further object of the invention is to provide an optical guide for detecting the remaining amount of developer, which optical guide has less light-transmission loss and needs a smaller space for fitting and smaller number of parts and is easy to fit, a process cartridge fitted with the optical guide, and an electrophotographic image forming apparatus capable of mounting the process cartridge detachably.

A still further object of the invention is to provide an optical guide having the following features, a process cartridge using the optical guide, and an electrophotographic image forming apparatus capable of mounting the process cartridge detachably. The optical guide is formed into one united body with a light-transmissive material and comprises a blocking portion for blocking an opening formed in a developer containing portion when the optical guide is fitted to the developer containing portion, an optical guide portion for guiding light, the optical guide portion being disposed on the outside of the developer containing portion with respect to the blocking portion when the optical guide is fitted to the developer containing portion, an outside inclining surface portion disposed at an end portion of the optical guide portion on the blocking portion side in the lengthwise direction of the optical guide portion, the outside inclining surface portion inclining to the side on which the optical guide portion is provided, an inside inclining surface portion disposed on a side positioned on the inside of the developer containing portion with respect to the blocking portion when the optical guide is fitted to the developer containing portion, the inside inclining surface portion inclining in a direction intersecting the lengthwise direction of the optical guide portion.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

In the following, a detailed description is given to an embodiment of a multicolor image forming apparatus as an electrophotographic image forming apparatus according to the present invention with reference to the attached drawings.

Whole Configuration of Multicolor Image Forming Apparatus

At first, the whole configuration of the multicolor image forming apparatus is roughly described with reference to FIG. 1. Incidentally, FIG. 1 is a longitudinal section showing the whole configuration of a full color laser beam printer 100 being an aspect of the multicolor image forming apparatus.

Figure 1:
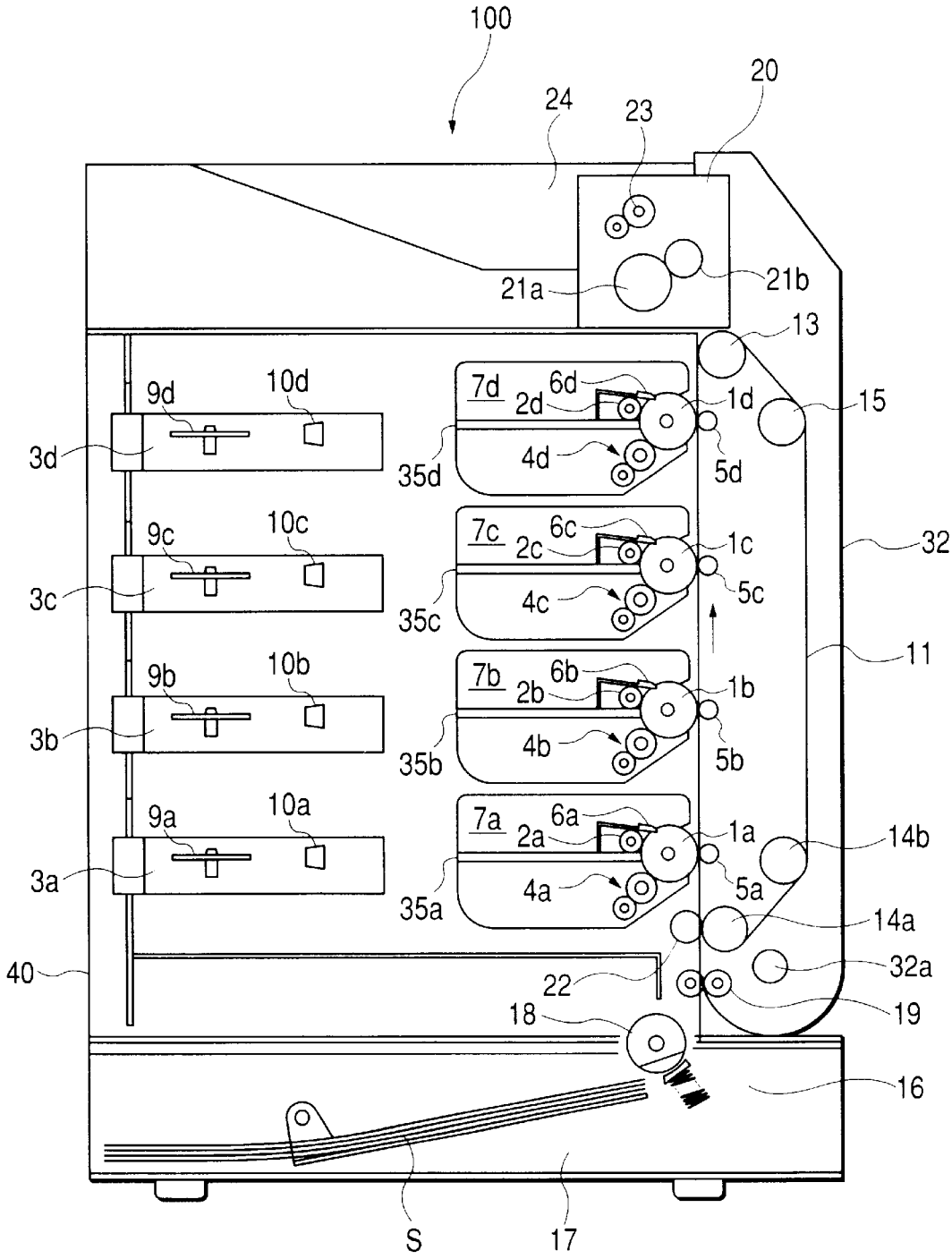
FIG. 1 is a longitudinal section of an electrophotographic image forming apparatus.

The printer 100 shown in FIG. 1 is equipped with four photosensitive drums 1 (1*a*, 1*b*, 1*c*, 1*d*) juxtaposed in a vertical direction. The drums 1 are driven to rotate in the counter-clockwise direction in FIG. 1 by driving means (not shown). The following devices are arranged around the drums 1 in order according to the rotation direction of the drums 1. That is, charging rollers 2 (2*a*, 2*b*, 2*c*, 2*d*) for charging the surfaces of the drums 1 uniformly, scanner units 3 (3*a*, 3*b*, 3*c*, 3*d*) for irradiating the drums 1 with laser beams modulated in accordance with image information to form electrostatic latent images on the drums 1, developing devices 4 (4*a*, 4*b*, 4*c*, 4*d*) for developing the electrostatic latent images as toner images by attaching toner on the electrostatic latent images, transfer rollers 5 (5*a*, 5*b*, 5*c*, 5*d*) for transferring the toner images on the drums 1 to a transferring material S, cleaning devices 6 (6*a*, 6*b*, 6*c*, 6*d*) for removing untransferred residual toner on the surface of the drums 1 after the transfer, and the like are arranged.

Hereupon, the drum 1, the charging roller 2, the developing device 4 and the cleaning device 6 are made into a process cartridge 7 (7*a*, 7*b*, 7*c*, 7*d*).

Hereinafter, those devices are described in order from the photosensitive drums 1.

The photosensitive drum 1 is made by the coating of an organic photosensitive layer (an OPC photosensitive member) on the outer periphery surface of, for example, an aluminum cylinder having a diameter of 30 mm. Both end portions of the drum 1 are rotatably supported by supporting members, and the drum 1 is driven to rotate in the counter-clockwise direction by the transmission of a driving force from a driving motor (not shown) to one end portion of the drum 1.

As the charging device in the embodiment, a charging device of a contact charging type can be used. A charging member used in the charging device is each of the conductive charging rollers 2 formed in a roller. The rollers 2 abut the surfaces of the photosensitive drums 1 and a charging bias voltage is applied to the rollers 2, and thereby the surfaces of the drums 1 are uniformly charged.

The scanner units 3 are severally disposed at substantially the same horizontal levels as those of the drums 1. In the units 3, image beams corresponding to image signals are generated by laser diodes (not shown) to irradiate polygon mirrors 9 (9*a*, 9*b*, 9*c*, 9*d*) rotated by scanner motors (not shown) at a high speed. The image beams that have been reflected by the polygon mirrors 9 selectively expose the charged surfaces of the drums 1 through imaging lenses 10 (10*a*, 10*b*, 10*c*, 10*d*), and then electrostatic latent images are formed.

The developing devices 4*a*, 4*b*, 4*c*, 4*d* contain yellow, magenta, cyan and black color toners, respectively.

An electrostatic-transfer belt 11 is disposed to circulate such that the belt 11 is opposed to and in contact with all photosensitive drums 1*a*, 1*b*, 1*c* and 1*d*. The belt 11 is made of a film-shaped member having a volume resistivity of $10^{11}$ to $10^{14}$ Ω·cm and a thickness of about 150 μm. Four rollers 13, 14*a*, 14*b*, and 15 support the belt 11 in a vertical direction. The belt 11 electrostatically attracts a transferring material S as a recording medium on its outer periphery surface on the left side of FIG. 1 while circulating in order to make the transferring material S contact the drums 1. Thereby, the transferring material S is transported to transferring positions by the belt 11, in which the toner images on the drums 1 are transferred on the transferring material S.

The transfer rollers 5 (5*a*, 5*b*, 5*c*, 5*d*) are juxtaposed at positions in which the rollers 5 abut against the inside of the belt 11 and are opposed to four drums 1*a*, 1*b*, 1*c* and 1*d*. Positive charges are applied to the material S from the rollers 5 through the belt 11. Owing to an electric field generated by the positive charges, negative toner images on the drums 1 are transferred onto the material S being in contact with the drums 1.

The belt 11 is about 700 mm in peripheral length and 150 μm in thickness. The belt 11 is looped around the four rollers, or the driving roller 13, the driven rollers 14*a*, 14*b* and the tension roller 15. The belt 11 rotates in the direction indicated by the arrow in FIG. 1. Thereby, the belt 11 cyclically moves to transfer toner images to the material S while the material S is transported from the side of the driven roller 14*a* to the side of the driving roller 13.

A feed portion 16 is a portion for feeding and transporting the transferring materials S to the image-forming portion. A plurality of transferring materials S is contained in a feed cassette 17 of the feed portion 16. At the time of image forming, a feed roller (a semicircular roller) 18 and a pair of registration rollers 19 are driven to rotate in response to the image forming operation, and the rollers 18 and 19 separate and feed the materials S in the cassette 17 one by one. The leading end of the transferring material S hits against the registration rollers 19 to stop once. Then, after a loop is formed in the transferring material S, the rotation of the belt 11 and the beginning position of writing on the transferring material S are synchronized. The transferring material S is then fed to the belt 11 by the registration rollers 19.

A fixing portion 20 is a portion for fixing multicolor toner images that have been transferred on the materials S. The fixing portion 20 is provided with a pair of fixing rollers 21 (21*a*, 21*b*) composed of a rotary heating roller 21*a* and a pressure roller 21*b* that is in pressure contact with the heating roller 21*a* for applying heat and pressure to the material S.

That is, the fixing rollers 21 transport the transferring material S, on which toner images on the drums 1 are transferred when the transferring material S passes through the fixing portion 20. Heat and pressure are applied on the transferring material S by the rollers 21 at the time of passing. Multicolor toner images are thereby fixed on the surface of the transferring material S.

As for the operation of image forming, the process cartridges 7*a*, 7*b*, 7*c* and 7*d* are sequentially driven in accordance with the timing of printing. The photosensitive drums 1*a*, 1*b*, 1*c* and 1*d* are driven to rotate in the counter-clockwise direction in accordance with the driving. Then, the scanner units 3 corresponding to the process cartridges 7 are sequentially driven. By this driving, charging rollers 2*a* to 2*d* uniformly induce electric charges on the peripheral surfaces of the drums 1. The scanner units 3 expose the peripheral surfaces of the drums 1 according to image signals to form electrostatic latent images on the surfaces. Developing rollers in the developing devices 4 transfer toner to the low electric-potential portions of the latent images to form, or to develop, toner images on the peripheral surfaces of the drums 1.

At the timing when the most upstream, leading end of the toner image on the peripheral surface of the photosensitive drum 1 is rotated to the point opposed to the electrostatic-transfer belt, the pair of the registration rollers 19 begins to rotate to feed the transferring material S to the belt 11 such that the position of the beginning of printing of the transferring material S is registered with the point.

The transferring material S is brought into pressure contact with the outer periphery of the belt 11 in such a way that the transferring material S is pinched between an electrostatic-attraction roller 22 and the belt 11. And, a voltage is applied between the belt 11 and the electrostatic-attraction roller 22. As a result, electric charges are induced on the transferring material S, which is a dielectric material, and a dielectric layer of the belt 11 such that the transferring material S is electrostatically attracted to the outer periphery of the belt 11. Consequently, the transferring material S is stably attracted to the belt 11 to be transported up to the transferring portion at the most downstream portion.

While the transferring material S is transported in such a way, toner images on the respective drums 1 are sequentially transferred on the transferring material S by the electric fields formed between the drums 1 and the transfer rollers 5.

The self-separation of the transferring material S, on which four-color toner images are transferred, from the belt 11 is performed by the curvature of the driving roller 13. The separated transferring material S is transported to the fixing portion 20. After the toner images are fixed on the transferring material S with heat, the transferring material S is delivered to the outside of the main body of the printer 100 from a delivery portion thereof by a pair of delivery rollers 23, with its image bearing surface facing downward.

Figure 2:
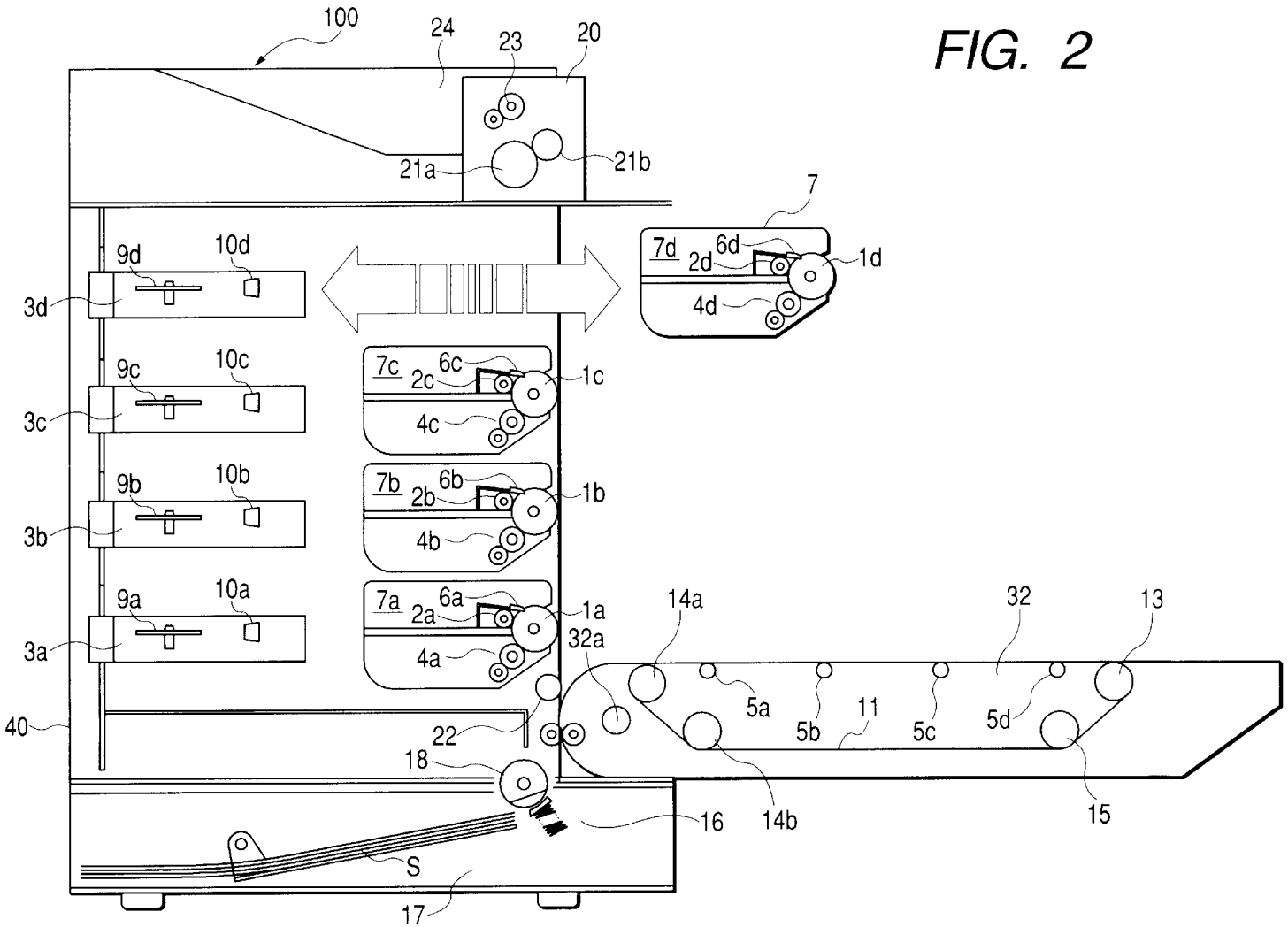
FIG. 2 is a longitudinal section of the electrophotographic image forming apparatus.
Figure 3:
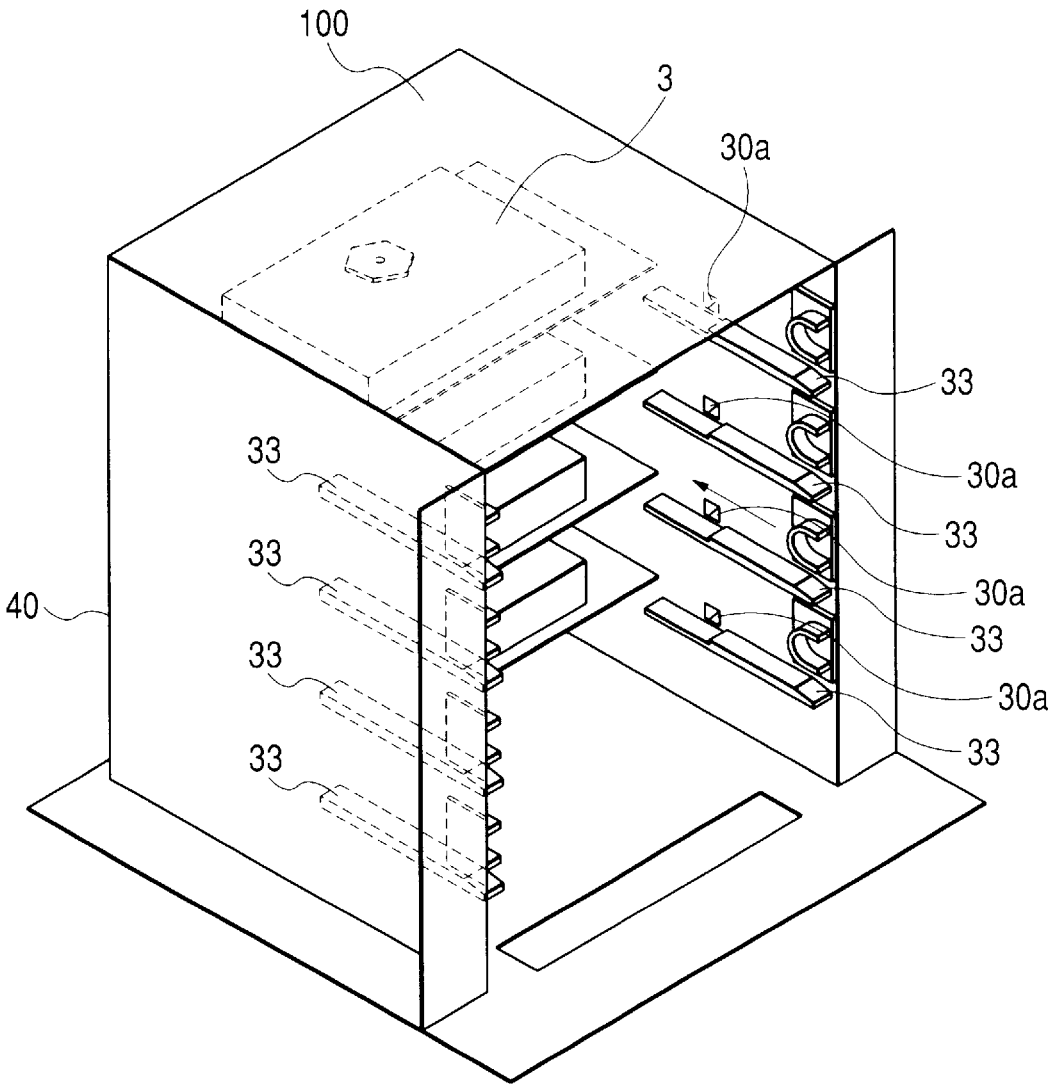
FIG. 3 is a perspective view of the main body of the electrophotographic image forming apparatus.
Figure 4:
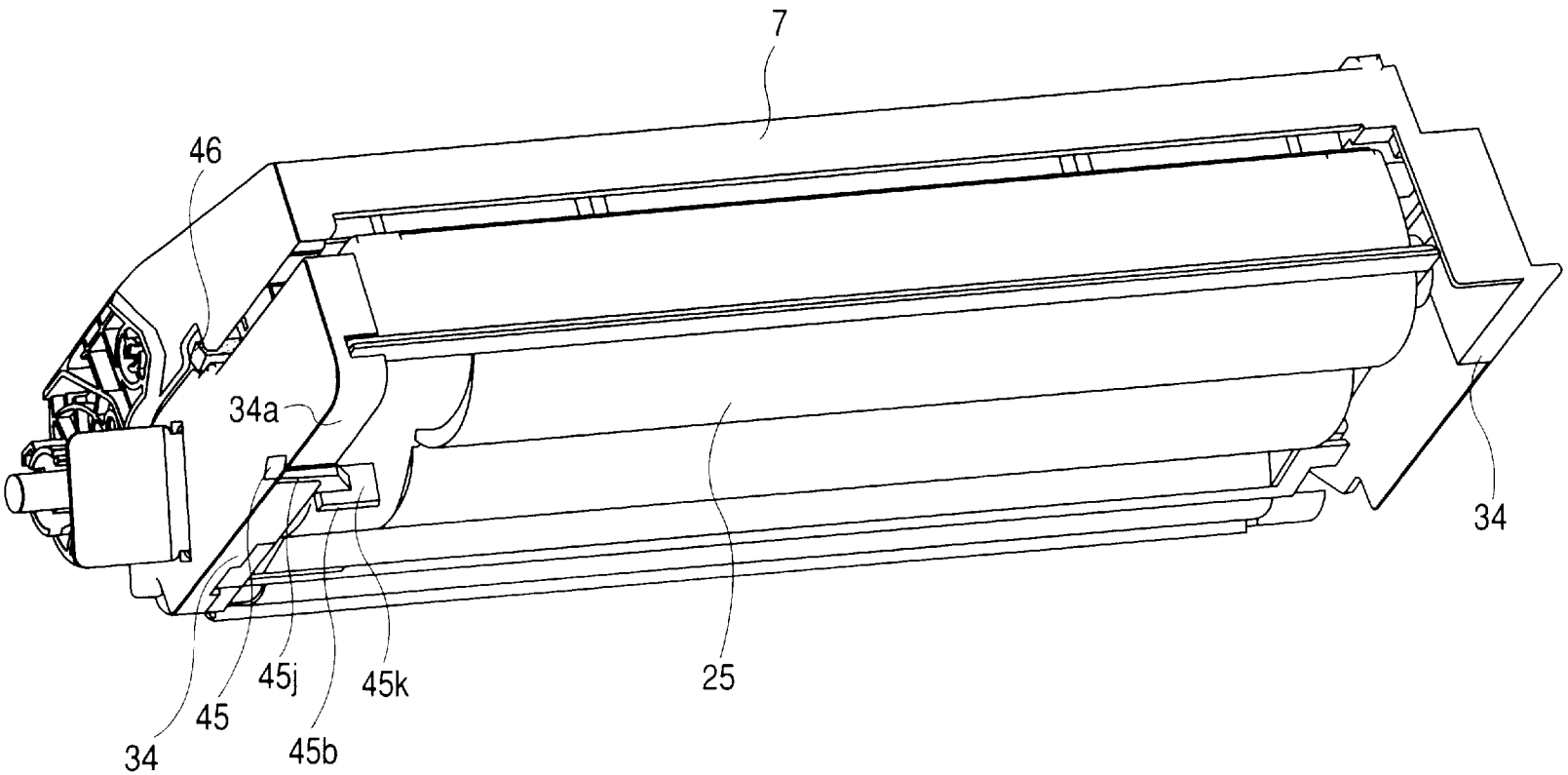
FIG. 4 is a perspective view of a process cartridge.
Figure 5:
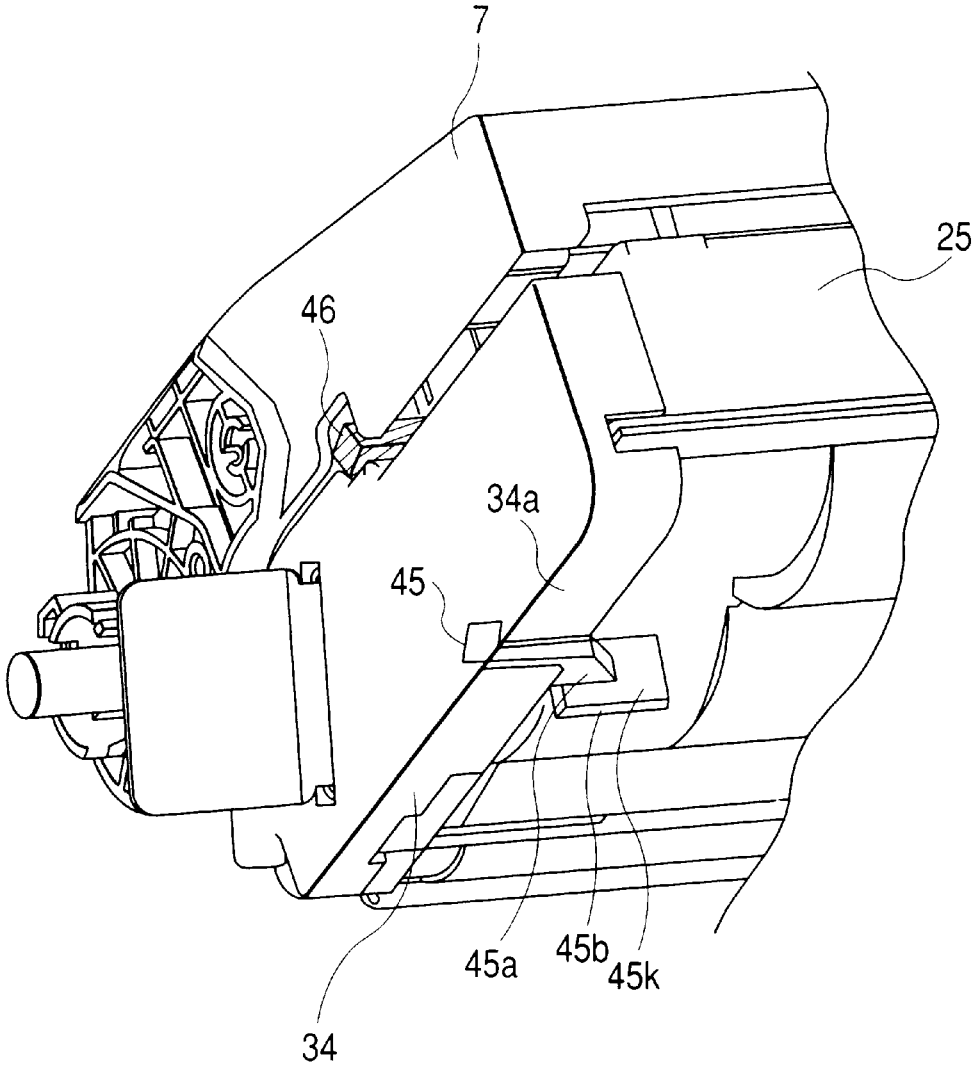
FIG. 5 is a perspective view of a part of the process cartridge.

Method of Mounting and Detaching Process Cartridge to and from Main Body of Image Forming Apparatus Next, a description is given to a method of mounting and detaching the process cartridges 7 to and from the main body of an image forming apparatus 40 with reference to FIG. 2 to FIG. 4. As shown in FIG. 2, the process cartridges 7 are detachably mountable to the main body 40. The main body 40 is configured such that the cartridges 7 are inserted into and extracted from the main body in horizontal directions, with the front door thereof 32 being open. The front door 32 rotates around a shaft 32*a* with respect to the main body 40 and assumes a standing state shown in FIG. 1 and a laid state shown in FIG. 2.

The aforesaid belt 11, the rollers 13, 14*a*, 14*b* and 15, each supporting the belt 11, and the transfer rollers 5*a*, 5*b*, 5*c* and 5*d* are all formed in the front door 32.

Moreover, as shown in FIG. 3 and FIG. 4, the main body 40 is configured such that the cartridges 7 are mounted to and detached from the main body 40 in the direction indicated by the arrow in FIG. 2 in such a way that guide rails 33 formed inside the main body 40 are engaged with the insertion guide portions 34 formed on the cartridges 7. When the cartridges 7 are inserted into the main body 40, the cartridges 7 are inserted along the guide rail portions 33 up to the most interior portion of the main body, with the front door 32 being open. The cartridges 7 stop in positions where the photosensitive drums 1 of the process cartridges 7 are aligned with each other on a straight line in a vertical direction. Moreover, when the cartridges 7 are detached from the main body 40, the cartridges 7 are drawn out along the guide rail portions 33 toward the front door 32 side to be removed from the main body 40.

Figure 6:
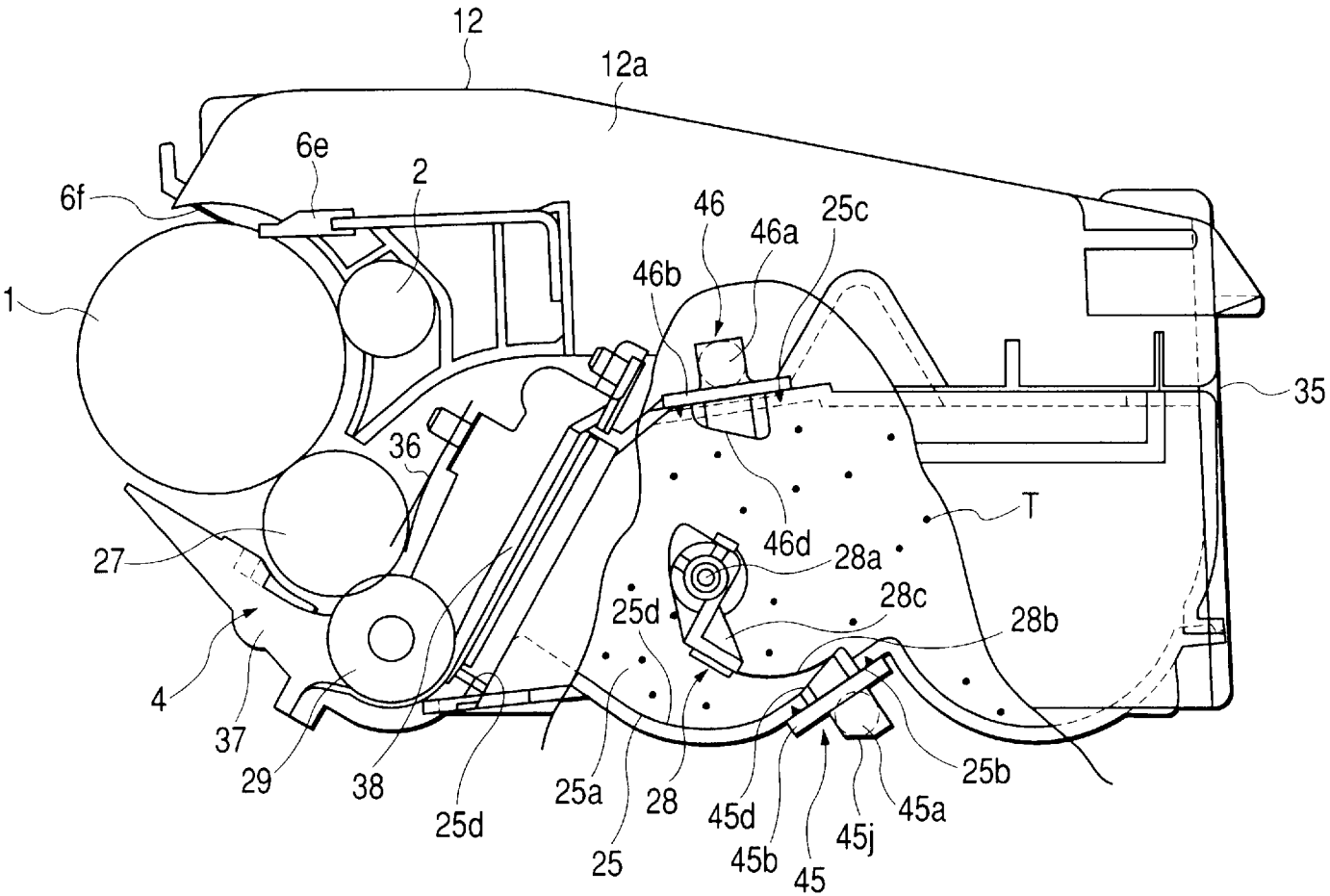
FIG. 6 is a longitudinal section of the process cartridge.

On the other hand, each of the cartridges 7 is equipped with an electrophotographic photosensitive member and at least one process means. Hereupon, as the process means, for example, charging means for charging the photosensitive member, developing means for developing a latent image formed on the photosensitive member, cleaning means for removing the toner remaining on the surface of the photosensitive member, and the like are cited. Each of the process cartridges 7 of the present embodiment is, as shown in FIG. 6, configured to perform the following operation. That is, the photosensitive drum 1, which is an electrophotographic photosensitive member including a photoconductive layer, is rotated. A voltage is applied to the charging roller 2 as the charging means to charge the surface of the photosensitive drum 1 uniformly. A light image is exposed from the scanner unit 3 to the charged drum 1 through an exposure-opening portion 35 (35*a*, 35*b*, 35*c*, 35*d*) to form a latent image. The developing device 4 as the developing means develops the latent image.

In the developing device 4, as shown in FIG. 6, toner is fed through an opening portion 25*d* with a rotary agitating member 28 as toner feeding means in a developer containing portion 25*a* of the developer container 25. The toner, that did not contribute the development, is scraped off by a supply roller 29, which is driven to rotate. Thereby, fresh toner can always be supplied to a developing roller 27. Then, together with the rotation of the developing roller 27, a toner layer, in which triboelectification charges are induced, is formed on the surface of the developing roller 27 with a developing blade 36. By transferring the toner in the toner layer onto the photosensitive drum 1 in accordance with the latent image, a toner image is formed as a visualized image. In the rotary agitating member 28, an agitating wing 28*b* is attached to a boss 28*c* fixed on a shaft 28*a*. The developer container 25 rotatably supports the shaft 28*a*, and one end of the shaft 28*a* extends to the outside of the developer container 25. The agitating wing 28*b* is made of a flexible plastic member. When the process cartridge 7 is brand-new, the opening portion 25*d* is sealed with a toner-sealing member 38 for preventing the leakage of the toner in the developer container 25. The toner-sealing member 38 is pulled out to the outside for the removal thereof. If the process cartridge 7 uses black magnetic toner, the supply roller 29 is not provided, but a stationary magnet is built in the developing roller 27.

After a voltage having a polarity opposite to a polarity of the toner image is applied to each of the transfer rollers 5*a* to 5*e* to transfer the toner image to the transferring material as a recording medium, the toner remaining on the drum 1 is removed by cleaning means. That is, the remaining toner is scraped off by a cleaning blade 6*e*, and the scraped off toner is dipped up with a dip sheet 6*f* to be collected to a removed toner containing portion 12*a* of a cleaning container 12.

The process cartridge 7 supports the photosensitive drum 1, the charging roller 2 and the cleaning blade 6*e*, and the process cartridge 7 includes a cleaning container 12 having the removed toner containing portion 12*a* therein. Moreover, a developing container 37 supports the developing roller 27 and the supply roller 29. The developer container 25 that contains toner supports the rotary agitating member 28 that performs the agitation of the toner and the feeding of the toner to the developing container 37. The developing container 37 and the developer container 25 are welded together by ultrasonic waves, and the like into a toner-developing frame. The toner-developing frame is rotatably coupled with the cleaning container 12 supporting each aforesaid member. An illustrated spring, the force of which operates in the direction of pressing the drum 1 against the developing roller 27, is provided between the developing container 37 and the cleaning container 12.

The developer container 25, the developing container 37 and the cleaning container 12 are formed by high impact polystyrene (HIPS).

Next, a description is given to an embodiment of the light-transmission-type toner-remaining-amount detection method that is a feature of the invention with reference to FIG. 6. Openings 25*b* and 25*c* are formed in the developer container 25 of the process cartridge 7 for containing toner T. The opening 25*b* is disposed on the lower side of the developer container 25. The opening 25*c* is disposed on the upper side of the developer container 25. Moreover, a first agitating member 28 and a second agitating member (not shown) are provided in the developer container 25 in order from a nearer side to the developing roller 27. By the rotation of the agitating members, the toner T is fed to the supply roller 29. The first agitating member 28 has also a wiping function for removing the toner T that adheres to optical guide portions 45*a* and 46*a* besides the function of the feeding of the toner T.

Figure 7:
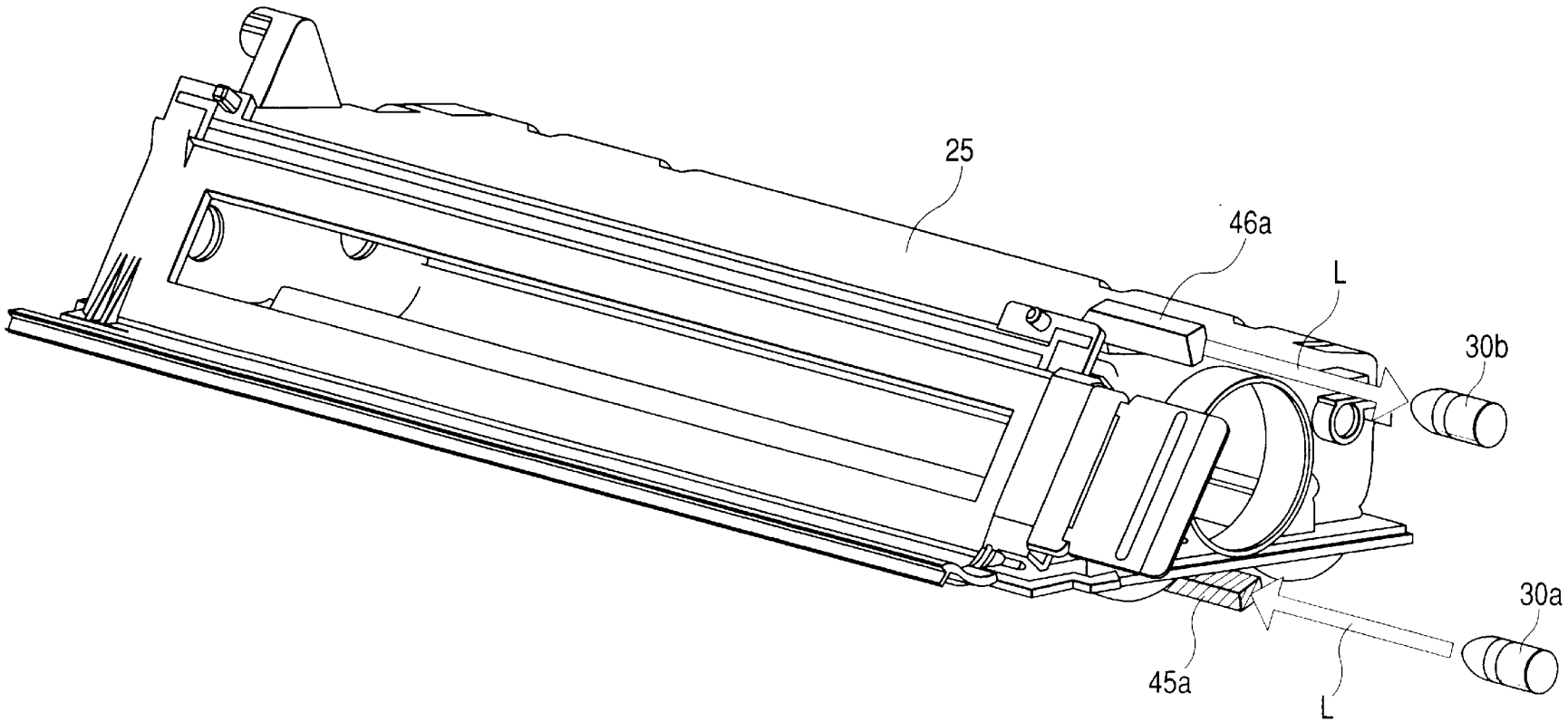
FIG. 7 is a perspective view of the process cartridge.
Figure 8:
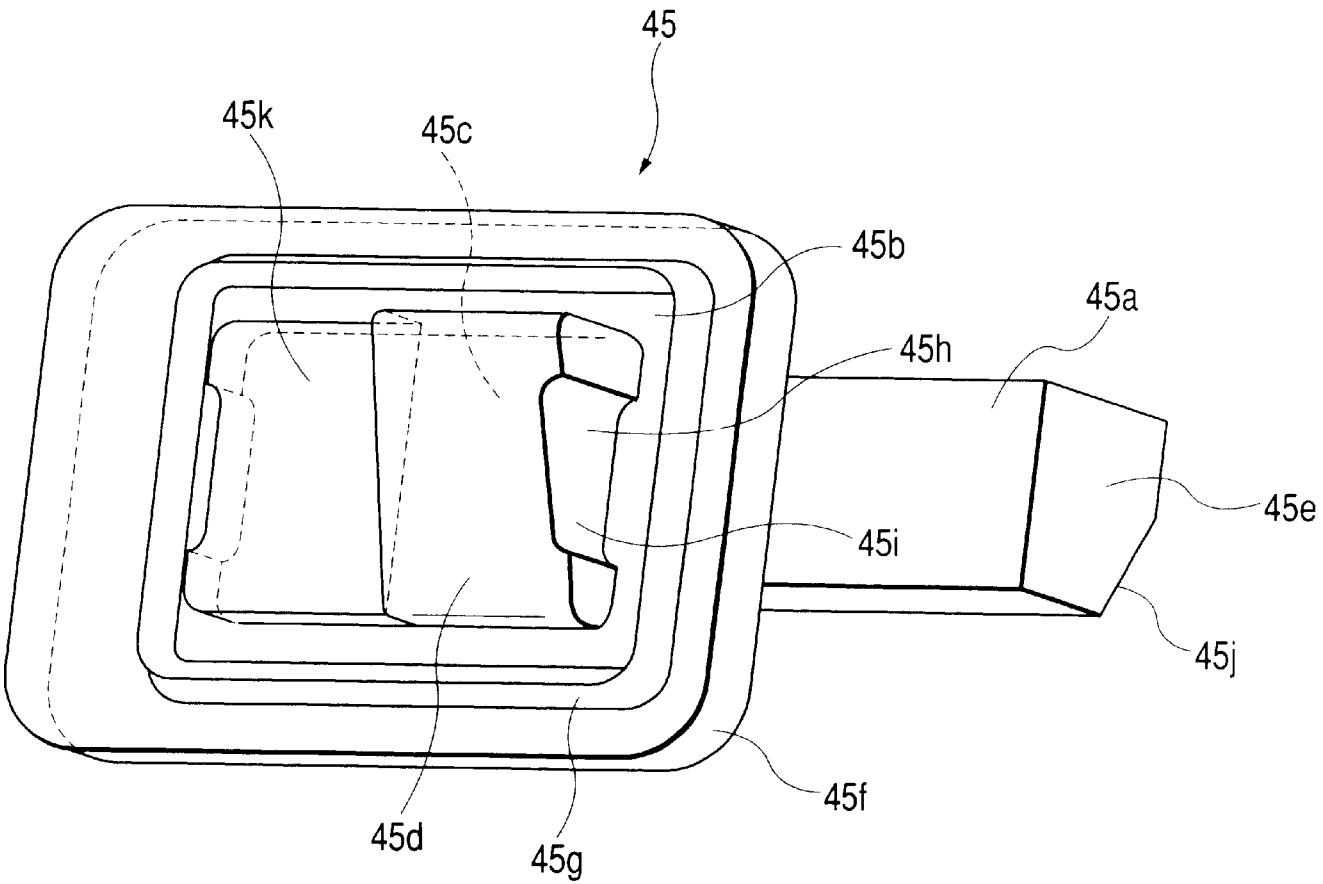
FIG. 8 is a perspective view of an optical guide.
Figure 9:
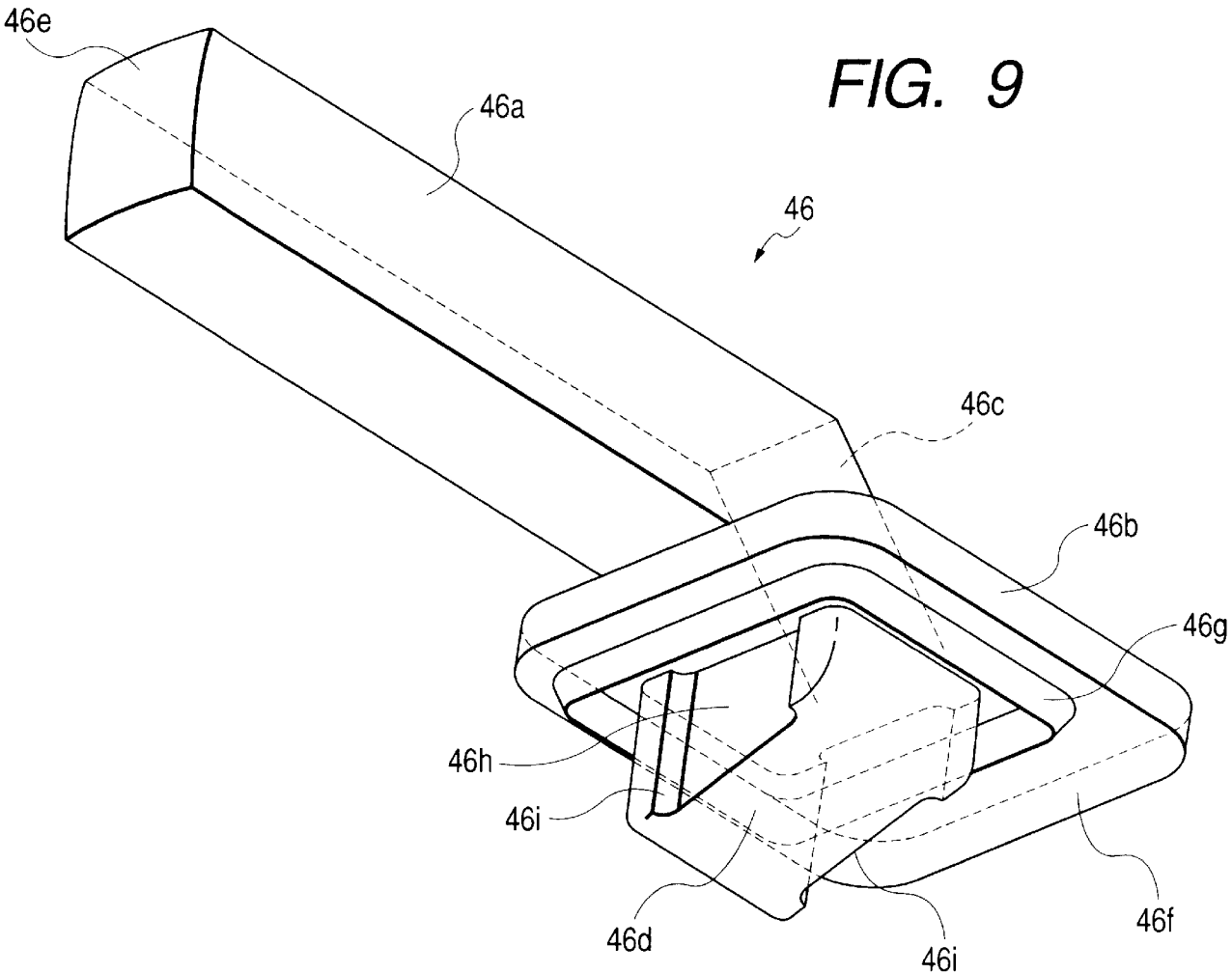
FIG. 9 is a perspective view of an optical guide.
Figure 10A:
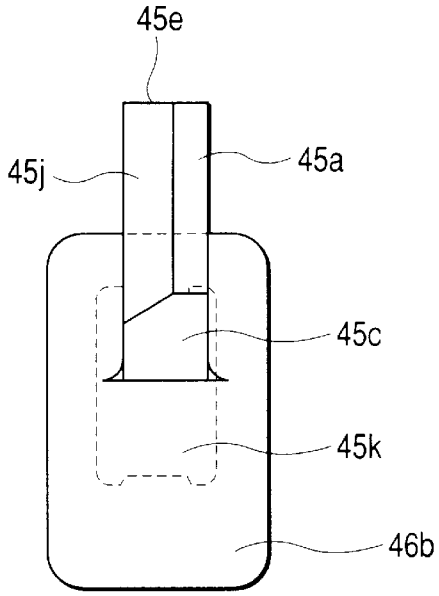
FIG. 10A is a front elevation of the optical guide on a light incidence side as viewed from the outside.
Figure 10B:
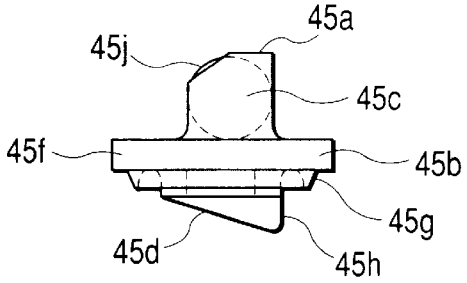
FIG. 10B is a side elevation of the optical guide.
Figure 10C:
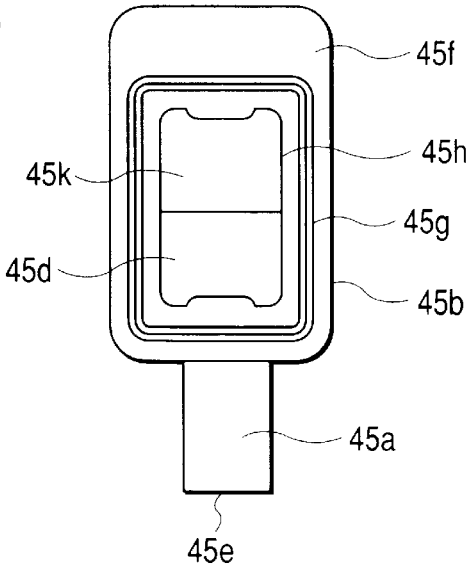
FIG. 10C is a back elevation of the optical guide.
Figure 11A:
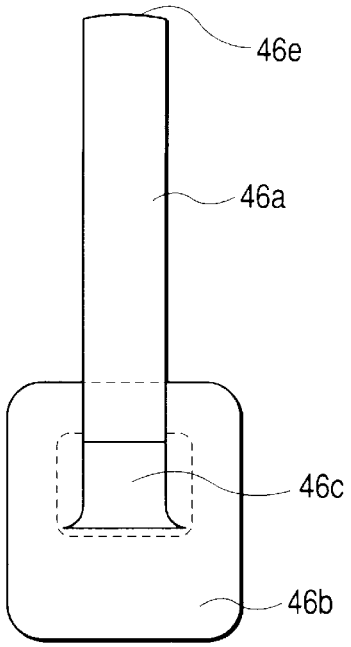
FIG. 11A is a front elevation of the optical guide on a light exit side as viewed from the outside.
Figure 11B:
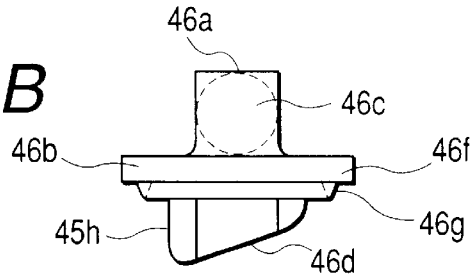
FIG. 11B is a side elevation of the optical guide.
Figure 11C:
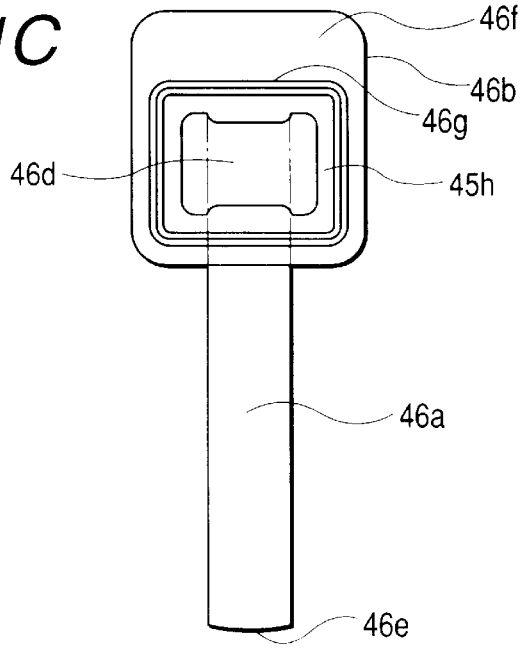
FIG. 11C is a back elevation of the optical guide.

Moreover, a light-emitting device 30*a* and a light-receiving device 30*b* are disposed on a side surface of the developer container 25 as shown in FIG. 7. A part of the detection light L emitted by the light-emitting device 30*a* passes through the optical guide portion 45*a* disposed along the lengthwise direction of the developer container 25 on the outside of the developer container 25, and the detection light L is refracted at the opening 25*b* and passes into the developer containing portion 25*a* in the developer container 25. Then, the light L passing through in the developer containing portion 25*a* enters into the optical guide portion 46*a*, and is refracted at the optical guide portion 46*a*. Then, a part of the light L that has emerged to the outside of the developer container 25 reaches the light-receiving device 30*b* through the optical guide portion 46*a*, which is also disposed along the lengthwise direction of the developer container 25. The remaining amount of the toner T contained in the developer container 25 is detected on the basis of how long the light-receiving device 30*b* receives the detection light L. Incidentally, the light-emitting device 30*a* is disposed on the lower side of the developer container 25 and the light-receiving device 30*b* disposed on the upper side of the developer container 25.

Now, because the rate of time when the light-receiving device 30*b* receives the detection light L varies according to the amount of the toner T in the developer containing portion 25*a*, when more than a certain degree of the toner T occupies the space in the developer containing portion 25*a*, the light that entered in the developer containing portion 25*a* through the optical guide portion 45*a* does not reach the optical guide portion 46*a* owing to the shield of the toner T. In this case, the light-receiving device 30*b* does not receive the detection light L. As the toner T in the developer containing portion 25*a* decreases, the rate of the passing of the light L between the optical guide portions 45*a* and 46*a* gradually increases owing to the agitation with the rotary agitating member 28. The remaining amount of the toner T can thereby be known.

The adoption of such a configuration makes it possible to detect the remaining amount of the toner T contained in the developer container 25 on the basis of the variations of the length of the time when the light-receiving device 30*b* receives the detection light L. Moreover, it also makes it possible to inform a user that the toner T in the developer container 25 is getting exhausted.

Now, for the improvement of the precision of the light-transmission-type remaining-amount detection method, the related art should increase the light amount of the detection light L in order that the light-receiving device 30*b* surely receives the detection light L that has passed through the developer container 25. For the sake of that, the following measures are required. That is, the increase of the light amount of the light-emitting device 30*a*, the widening of the incidence surface of the optical guide portion 31*a* and the exit surface of the optical guide portion 31*b*, or the provision of a condensing member such as a lens between the light-emitting device 30*a* and the optical guide portion 31*a* and between the light-receiving device 30*b* and the optical guide portion 31*b* is needed.

In particular, the incidence surface of the optical guide portion 31*a* is needed to be as large as possible for the sake of the securement of the reception of the detection light L emitted by the light-emitting device 30*a* first without loss. However, the designing of the optical guide portion 31*a* with a large incidence surface makes the size of the optical guide portion 31*a* as a part large, and thereby the optical guide portion 31*a* protrudes from the insertion guide portion 34 of the process cartridge 7 as a result. In such a configuration, the protruding guide portion 31*a* interferes with the guide rail 33 at the time of the insertion or the extraction of the process cartridge 7 into or from the main body 40 of an image forming apparatus in which the process cartridge 7 is arranged at a developing position in the main body 40.

However, when the optical guide portion 31*a* is designed to be small lest the optical guide portion 31*a* should interfere with the guide rail 33, it becomes difficult to make the sufficient amount of detection light L enter into the developer container 25. As a result, the precision of the detection of the remaining amount of toner deteriorates.

Accordingly, the embodiment of the present invention is provided with the optical guide portions 45*a* on guide surfaces 34*a*, which slide on the guide rails 33, of the insertion guide portions 34. Moreover, the lengths between the light-emitting devices 30*a* and the light incidence surfaces of the optical guide portions 45*a* and the lengths between the light-receiving devices 30*b* and the exit surfaces of the optical guide portions 46*a* are shortened. Moreover, the light from the devices 30*a* is made to reach the developer containing portions 25*a* only through the optical guide portions 45*a*. Furthermore, the lights received by the optical guide portions 46*a* at the developer containing portions 25*a* are made to pass through the optical guides portion 46*a*, the exit surfaces of which are opposed to the light-receiving devices 30*b*.

Although the related art, in which the openings 25*b* and 25*c* are provided with transparent windows, severally, has loss of light (reflection loss at the windows and the loss caused by the entering of light into different media), this embodiment does not suffer any of such losses because the embodiment is configured in a certain way.

The configurations of optical guides 45 and 46 of the present invention are next described.

The optical guides 45 and 46 are used for detecting the remaining amount of developer contained in the developer containing portion 25*a*, and are shown in FIG. 8, FIG. 9, FIGS. 10A to 10C, and FIGS. 11A to 11C.

The optical guides 45 and 46 severally include blocking portions 45*b* and 46*b*, the optical guide portions 45*a* and 46*a* for guiding light, outside inclining surface portions 45*c* and 46*c*, and inside inclining surface portions 45*d* and 46*d* inclining toward a direction intersecting the lengthwise direction of the optical guide portions 45*a* and 46*a*. These elements of the optical guides 45 and 46 are formed into one united body with a light-transmissive material, respectively. The blocking portions 45*b* and 46*b* block the openings 25*b* and 25*c* formed in the developer containing portion 25*a* when the optical guides 45 and 46 are fitted to the developer containing portion 25*a*. The optical guide portions 45*a* and 46*a* are formed on the outside of the developer containing portion 25*a* against the blocking portions 45*b* and 46*b* when the optical guides 45 and 46 are fitted to the developer containing portion 25*a*. The outside inclining surface portions 45*c* and 46*c* are inclined toward the optical guide portions 45*a* and 46*a* at about 45 degrees with respect to the blocking portions 45*b* and 46*b* formed on the end portions of the optical guide portions 45*a* and 46*a* on the blocking portions 45*b* and 46*b* side in the lengthwise direction of the optical guide portions 45*a* and 46*a*. The inside inclining surface portions 45*d* and 46*d* are formed on the inside of the developer containing portion 25*a* with respect to the blocking portions 45*b* and 46*b* when the optical guides 45 and 46 are fitted to the developer containing portion 25*a*.

The optical guides 45 and 46 are used for guiding the light emitted by the light-emitting device 30*a* provided as a light-emitting member into the inside of the developer containing portion 25*a*. Moreover, the optical guides 45 and 46 are used for guiding the light that has passed through the inside of the developer containing portion 25*a* into the light-receiving device 30*b* provided as a light-receiving member.

Moreover, a viewing portion 45*k*, through which the color of the developer contained in the developer containing portion 25*a* can be viewed, is formed in the blocking portion 45*b*.

In the optical guide 46 used for guiding the light that has passed through the inside of the developer containing portion 25*a* into the light-receiving device 30*b*, the end portion 46*e* of the optical guide 46, on the opposite side to the end portion of the blocking portion 46*b* of the optical guide portion 46*a* in the lengthwise direction of the optical guide portion 46*a*, is convex toward the light-receiving device 30*b*. By the operation of this convexity, the exiting light from the optical guide portion 46*a*, is condensed into the light-receiving device 30*b*.

In the optical guides 45 and 46, the optical guide portions 45*a* and 46*a* and the blocking portions 45*b* and 46*b* are formed into one united body, respectively. These portions 45*a*, 46*a*, 45*b* and 46*b* have a light-transmissive property. The material conducive to the light-transmissive property is polystyrene.

The process cartridge 7 capable of being detachably mounted on the main body of an electrophotographic image forming apparatus has the following configuration:

(a) the electrophotographic photosensitive drum 1;

(b) the developing roller 27, the supply roller 29 and the developing blade 3, all being developing members used for the developing of an electrostatic latent image formed on the electrophotographic photosensitive drum 1;

(c) the developer containing portion 25*a* for containing the developer to be used for the developing of the electrostatic latent image with the developing members;

(d) the first optical guide 45 formed into one united body with a light-transmissive material, the first optical guide 45 including: the blocking portion 45*b* for blocking the opening 25*b* formed in the developer containing portion 25*a*; the optical guide portion 45*a* for guiding the light emitted by the light-emitting device 30*a* as a light-emitting member provided in the main body 40 of the apparatus into the developer containing portion 25*a*, the optical guide portion 45*a* being formed on a side positioned on the outside of the developer containing portion 25*a* with respect to the blocking portion 45*b*; the outside inclining surface portion 45*c* inclined toward the side, on which the optical guide portion 45*a* is formed, at an angle of about 45 degrees with respect to the blocking portion 45*b*, the outside inclining surface portion 45*c* being formed at an end portion of the optical guide portion 45*a* on the blocking portion 45*b* side in the lengthwise direction of the optical guide portion 45*a*; and the inside inclining surface portion 45*d* inclined toward a direction intersecting the lengthwise direction of the optical guide portion 45*a*, the inside inclining surface portion 45*d* being formed on a side to be positioned on the inside of the developer containing portion 25*a* with respect to the blocking portion 45*b*; and (e) the second optical guide 46 formed into one united body with a light-transmissive material, the second optical guide 46 including: the blocking portion 46*b* for blocking the opening 25*c* formed in the developer containing portion 25*a*; the optical guide portion 46*a* for guiding the light that has passed through the developer containing portion 25*a* to the light-receiving member 30*b* being a light-receiving member provided on the main body 40 of the apparatus, the optical guide portion 46*a* being formed on a side positioned on the outside of the developer containing portion 25*a* with respect to the blocking portion 46*b*; the outside inclining surface portion 46*c* inclined toward the side, on which the optical guide portion 46*a* is formed, at an angle of about 45 degrees with respect to the blocking portion 46*b*, the outside inclining surface portion 46*c* being formed at an end portion of the optical guide portion 46*a* on the blocking portion 46*b* side in the lengthwise direction of the optical guide portion 46*a*; and the inside inclining surface portion 46*d* inclined toward a direction intersecting the lengthwise direction of the optical guide portion 46*a*, the inside inclining surface portion 46*d* being formed on the side to be positioned on the inside of the developer containing portion 25*a* with respect to the blocking portion 46*b*.

Moreover, the first optical guide 45 and the second optical guide 46 are provided on a side of one end of the developing roller 27 as the developing member in the lengthwise direction thereof. Moreover, the first optical guide 45 is provided on the side to be positioned at a lower portion when the process cartridge 7 is mounted on the main body 40 of the apparatus. Moreover, the second optical guide 46 is provided on the side to be positioned at an upper portion when the process cartridge 7 is mounted on the main body 40 of the apparatus.

Moreover, the rotary agitating member 28 for feeding the toner contained in the developer containing portion 25*a* toward a side on which the developing member is provided is provided in the developer containing portion 25*a*. The agitating wing 28*b* that is made of a flexible plastic sheet and is provided on the rotary agitating member 28 is brought into contact with the inside inclining surface portions 45*d* and 46*d* formed on the first optical guide 45 and the second optical guide 46 each time the rotary agitating member 28 revolves.

Moreover, the viewing portion 45*k*, through which the color of the developer contained in the developer containing portion 25*a* can be viewed, is formed in at least any one of the blocking portions 45*b* and 46*b*.

The end portion 46*e* of the optical guide portion 46*a* of the second optical guide 46, the end portion 46*e* being opposite to the end portion of the optical guide portion 46*a* on the blocking portion 46*b* side in the lengthwise direction of the optical guide portion 46*a*, has a convex shape.

An electrophotographic image forming apparatus for forming an image on a recording medium, the apparatus capable of mounting a process cartridge detachably, has the following configuration.

That is, the apparatus comprises:

(a) the light-emitting device 30*a* being a light-emitting member for emitting light;

(b) the light-receiving device 30*b* being a light-receiving member for receiving the light; and (c) mounting means for mounting the process cartridge 7 detachably, the process cartridge 7 comprising:

(1) the electrophotographic photosensitive drum 1;

(2) a developing member to be used for developing an electrostatic latent image formed on the electrophotographic photosensitive drum 1;

(3) the developer containing portion 25*a* for containing developer to be used for the developing of the electrostatic latent image with the developing member;

(4) the first optical guide 45 formed into one united body with a light-transmissive material, the first optical guide 45 including: the blocking portion 45*b* for blocking the opening 25*b* formed in the developer containing portion 25*a*; the optical guide portion 45*a* for guiding the light emitted by the light-emitting member provided in the main body 40 of the apparatus into the developer containing portion 25*a*, the optical guide portion 45*a* being formed on a side positioned on the outside of the developer containing portion 25*a* with respect to the blocking portion 45*b*; the outside inclining surface portion 45*c* inclined toward the side, on which the optical guide portion 45*a* is formed, at an angle of about 45 degrees with respect to the blocking portion 45*b*, the outside inclining surface portion 45*c* being formed at an end portion of the optical guide portion 45*a* on the blocking portion 45*b* side in the lengthwise direction of the optical guide portion 45*a*; and the inside inclining surface portion 45*d* inclined toward a direction intersecting the lengthwise direction of the optical guide portion 45*a*, the inside inclining surface portion 45*d* being formed on a side to be positioned on the inside of the developer containing portion 25*a* with respect to the blocking portion 45*b*; and (5) the second optical guide 46 formed into one united body with a light-transmissive material, the second optical guide 46 including: the blocking portion 46*b* for blocking the opening 25*c* formed in the developer containing portion 25*a*; the optical guide portion 46*a* for guiding the light that has passed through the developer containing portion 25*a* to the light-receiving member provided on the main body 40 of the apparatus, the optical guide portion 46*a* being formed on the side positioned on the outside of the developer containing portion 25*a* with respect to the blocking portion 46*b*; the outside inclining surface portion 46*c* inclined toward the side, on which the optical guide portion 46*a* is formed, at an angle of about 45 degrees with respect to the blocking portion 46*b*, the outside inclining surface portion 46*c* being formed at an end portion of the optical guide portion 46*a* on the blocking portion 46*b* side in the lengthwise direction of the optical guide portion 46*a*; and the inside inclining surface portion 46*d* inclined toward a direction intersecting the lengthwise direction of the optical guide portion 46*b*, the inside inclining surface portion 46*d* being formed on the side to be positioned on the inside of the developer containing portion 25*a* with respect to the blocking portion 46*b*.

The optical guide portions 45*a* and 46*a* extend from their end portions 45*e* and 46*e* in the respective lengthwise directions, and are refracted at the outside of the blocking portions 45*b* and 46*b*, respectively. Then, the optical guide portions 45*a* and 46*a* pass through the blocking portions 45*b* and 46*b*, respectively, and reach the inside of the developer container 25. Then, the end portions opposite to the end portions 45*e* and 46*e* are formed as the inside inclining surface portions 45*d* and 46*d*, respectively.

The blocking portions 45*b* and 46*b* include flanges 45*f* and 46*f* touchable to the planes on the outsides of the edges of the openings 25*b* and 25*c* of the developer container 25. The flanges 45*f* and 46*f* includes ribs 45*g* and 46*g*, respectively, for performing the ultrasonic welding of the flanges 45*f* and 46*f* to the openings 25*b* and 25*c*. Inside optical guide portions 45*h* and 46*h* having the inside inclining surface portions 45*d* and 46*d*, respectively, are formed in the insides of the flange 45*f* and 46*f* such that the inside optical guide portions 45*h* and 46*h* are surrounded by the ribs 45*g* and 46*g*.

The inside of the flange 45*f* of the optical guide 45 on the incidence side into which light from the light-emitting device 30*a* enters includes the viewing portion 45*k* having an inside surface parallel to the flat surface of the flange 45*f*. Any of the outside surfaces of the flanges 45*f* and 46*f* are flat surfaces, and the inside and the outside surfaces of the viewing portion 45*k* are plane in parallel to each other. The inside optical guide portions 45*h* and 46*h* respectively include concave portions 45*i* and 46*i* in their side surfaces. The concave portions 45*i* and 46*i* makes it possible to make the thicknesses of the optical guide portions 45*a* and 46*a* thin, and thereby the moldability thereof can be improved. Moreover, the concave portions 45*h* and 46*h* also make it possible to form the fitting portions to the main body 40 as large as possible, and thereby the precision of positioning is improved. Furthermore, their reliability is improved.

The cross section of the optical guide portion 45*a* of the optical guide 45 on the incidence side is a shape such that large corner chamfering 45*j* of one corner of a square shape is performed. The corner chamfering 45*j* is performed for the prevention of the projection of the optical guide portion 45*a* from the guide surface 34*a* of the insertion guide portion 34 to the outside as shown in FIGS. 4 and 6. Incidentally, the cross section of the optical guide portion 46*a* is rectangular.

Next, the optical guides 45 and 46 of the process cartridge 7 are described.

The optical guides 45 and 46 include the ribs 45*g* and 46*g* for ultrasonic welding, respectively. The ribs 45*g* and 46*g* are welded in the vicinity of the openings 25*b* and 25*c* of the developer container 25, respectively. The flanges 45*f* and 46*f* are members for receiving an ultrasonic hone at the time of the ultrasonic welding. The flanges 45*f* and 46*f* are adhered to the outside edges of the openings 25*b* and 25*c* by touching to the edges. The ultrasonic welding makes the adhesion.

In the present embodiment, an optical guide, in which an optical guide portion and a blocking portion are formed into one united body is used. As a result, light passes through fewer different media. Consequently, much light can reach a light-receiving device from a light-emitting device.

Figure 12:
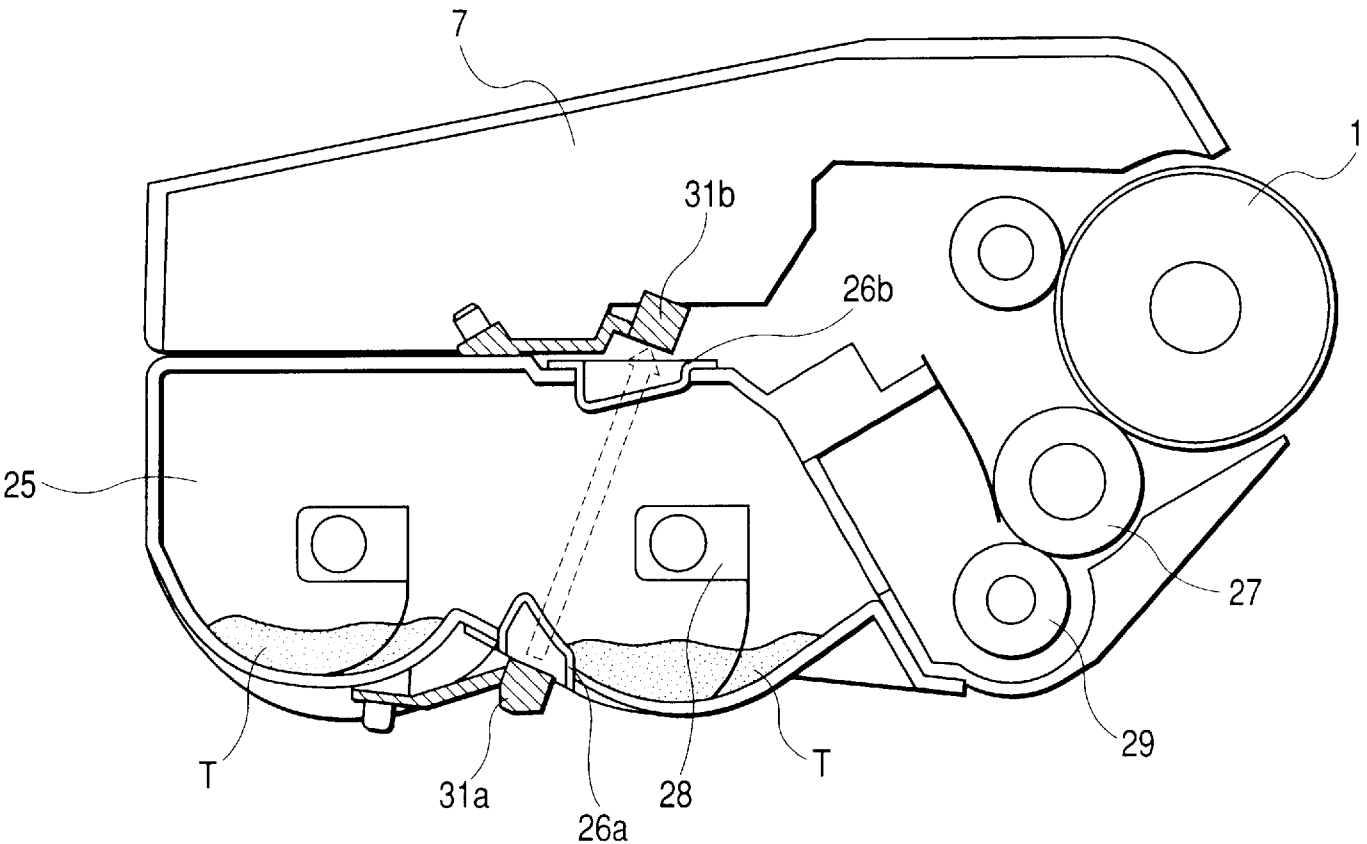
FIG. 12 is a longitudinal section of an earlier technology.

As shown in FIG. 6, the inside inclining surface portions 45*d* and 46*d* of the optical guide portions 45*a* and 46*a* are formed so as to incline toward the opening portion 25*d* of the developer container 25. Consequently, the detection light L1 can detect the remaining amount of the toner T at a lower position in comparison with the detection light L100 of the related art (shown in FIG. 12) owing to the difference of the refraction indices of light between polystyrene and air. Consequently, the detection of the state of toner being used up can surely be performed.

Accordingly, the light-emitting device and the optical guide can be positioned in a gap of the developer container between a first agitating member and a second agitating member, not at the lower portion of the developer container. Thereby, the process cartridge can be made to be small.

Furthermore, a line connecting the center of the inside inclining surface portions 45*d* and 46*d* of the optical guide portions 45*a* and 46*a* with the shaft 28*a* of the rotary agitating member 28 is substantially perpendicular to the surfaces of the inside inclining surface portions 45*d* and 46*d*, respectively.

For keeping the aforesaid relational positions, the configuration of the embodiment is such that the optical guide 45, into which light enters from the light-emitting device 30*a*, is fitted to the lower side, and the optical guide 46, through which the light entering into the light-receiving device 30*b* passes, is fitted to the upper side.

Moreover, the optical guides 45 and 46 are disposed at positions further than the position of the shaft 28*a* of the rotary agitating member 28 when they are viewed from the lower portion of the opening 25*d* through which toner is fed.

Moreover, the inside inclining surface 45*d* of the inside guide portion 45*h* of the optical guide portion 45*a* is arranged at a position where the inside inclining surface 45*d* substantially continues to the circular arc of the bottom 25*d* of the developer container 25. Incidentally, the shape of the bottom 25*d* is substantially a circular arc around the shaft 28*a* of the rotary agitating member 28. The distances of the inside inclining surface portions 45*d* and 46*d* of the optical guide portions 45*a* and 46*a* from the shaft 28*a* of the rotary agitating member 28 are substantially the same. Then, because the agitating wing 28*b* made of a flexible plastic sheet rubs the inside inclining surface portions 45*d* and 46*d* when the rotary agitating member 28 rotates, the inside inclining surface portions 45*d* and 46*d* that easily become dirty from toner T are always cleaned up. Consequently, the remaining amount of the developer T can easily be known.

When the process cartridge 7 is on the outside of the main body 40 of the apparatus, it is needed to distinguish the color of the toner T in the developer container 25. Because the viewing portion 45*k* is formed in the optical guide 45 in the present embodiment, the color of the toner T can directly be distinguished by sight. Thus, there is little possibility that the color of the toner of a process cartridge is mistaken.

In the present embodiment, the optical guide is made from polystyrene. In the case where the optical guide is made from polystyrene, there is a first problem that the light transmittance of polystyrene is 89% compared to the light transmittance of acrylic resin, which is 95% and thus this low light transmittance must be overcome. Accordingly, the present invention disposes the incidence plane and the exit plane of the optical guide portion such that one of them is in the inside of the developer container and the other of them is on the outside of the container, although both of them are on the outside of the container in the related art. Consequently, detection light enters into or exits from the developer container only through the optical guide portion.

Because the optical guide is formed from the same material as that of the developer container and polystyrene has a toner charging polarity more approximate to toner that charges to negative polarity than that of acryl in the present invention, the invention has an advantage that it is hard for toner to attach to the light-transmissive member.

Although the viewing portion is formed on only one side of the toner container, the sight portion can be formed on the other side or both of the sides when inspection can be performed from the outside.

Because an optical guide portion and a blocking portion are formed into one united body in the present invention as described above, the optical guide according to the invention is small in size and strong in toughness, and further the light transmittance thereof can be maintained in a good state owing to its configuration. Moreover, because a viewing portion is formed, it is hard to mistake the color of developer when the optical guide is used for a process cartridge. Furthermore, the number of man hours required for assembly is small, and fixation is strong.

While the invention has been described with reference to the structure disclosed herein, it is not confined to the details set forth and this application is intended to cover such modifications or changes as may come within the purpose of the improvement or the scope of the following claims.

What is claimed is:

1. An optical guide to be used for detecting a remaining amount of developer contained in a developer containing portion, said optical guide comprising:

a blocking portion for blocking an opening formed in the developer containing portion when said optical guide is fitted to the developer containing portion;

an optical guide portion for guiding light, said optical guide portion being formed on a side to be positioned on an outside of the developer containing portion with respect to said blocking portion when said optical guide is fitted to the developer containing portion;

an outside inclining surface portion inclining toward the side, on which said optical guide portion is formed, with respect to said blocking portion, said outside inclining surface portion being formed at an end portion of said optical guide portion on a blocking-portion side in a lengthwise direction of said optical guide portion; and an inside inclining surface portion inclining toward a direction intersecting the lengthwise direction of said optical guide portion, said inside inclining surface portion being formed on a side to be positioned on an inside of said developer containing portion with respect to said blocking portion when said optical guide is fitted to said developer containing portion, wherein said optical guide is formed into one united body with a light-transmissive material.

2. An optical guide according to claim 1, wherein said optical guide may be used for guiding light emitted by a light-emitting member into said developer containing portion, or, said optical guide may be used for guiding light that has passed through said developer containing portion to a light-receiving member, and said blocking portion is provided with a viewing portion through which a color of the developer contained in the developer containing portion can be viewed.

3. An optical guide according to claim 2, wherein an end portion of said optical guide portion of said optical guide, which is used for guiding the light that has passed through the developer containing portion to the light-receiving member, and which is opposite to said end portion of said optical guide portion on said blocking-portion side in the lengthwise direction of said optical guide portion, has a convex shape.

4. An optical guide according to any one of claims 1 to 3, wherein said light-transmissive material is polystyrene.

5. An optical guide according to any one of claims 1 to 3, wherein said outside inclining surface portion inclines substantially at an angle of about 45 degrees with respect to said blocking portion.

6. A process cartridge detachably mountable on a main body of an electrophotographic image forming apparatus, said process cartridge comprising:

(a) an electrophotographic photosensitive member;

(b) a developing member to be used for developing an electrostatic latent image formed on said electrophotographic photosensitive member;

(c) a developer containing portion for containing developer to be used for developing the electrostatic latent image by said developing member;

(d) a first optical guide formed into one united body with a light-transmissive material, said first optical guide including:

a blocking portion for blocking a first opening formed in said developer containing portion;

an optical guide portion for guiding light emitted by a light-emitting member provided in the main body of the apparatus into said developer containing portion, said optical guide portion being formed on a side positioned on an outside of said developer containing portion with respect to said blocking portion;

an outside inclining surface portion inclining toward the side, on which said optical guide portion is formed, with respect to said-blocking portion, said outside inclining surface portion being formed at an end portion of said optical guide portion on a blocking portion side in a lengthwise direction of said optical guide portion; and an inside inclining surface portion inclining toward a direction intersecting the lengthwise direction of said optical guide portion, said inside inclining surface portion being formed on a side to be positioned on an inside of said developer containing portion with respect to said blocking portion; and (e) a second optical guide formed into one united body with a light-transmissive material, said second optical guide including:

a blocking portion for blocking a second opening formed in said developer containing portion;

an optical guide portion for guiding light that has passed through said developer containing portion to a light-receiving member provided on the main body of the apparatus, said optical guide portion being formed on a side positioned on the outside of said developer containing portion with respect to said blocking portion of said second optical guide;

an outside inclining surface portion inclining toward the side, on which said optical guide portion of said second optical guide is formed, with respect to said blocking portion of said second optical guide, said outside inclining surface portion being formed at an end portion of said optical guide portion of said second optical guide on a blocking portion side of said second optical guide in a lengthwise direction of said optical guide portion of said second optical guide; and an inside inclining surface portion inclining toward a direction intersecting the lengthwise direction of said optical guide portion of said second optical guide, said inside inclining surface portion being formed on a side to be positioned on the inside of said developer containing portion with respect to said blocking portion of said second optical guide.

7. A process cartridge according to claim 6, wherein said first optical guide and said second optical guide are formed on a side of one end of a developing roller as said developing member in a lengthwise direction thereof, wherein said first optical guide is provided on a side to be positioned at a lower portion when said process cartridge is mounted on the main body of the apparatus, and wherein said second optical guide is provided on a side to be positioned at an upper portion when said process cartridge is mounted on the main body of the apparatus.

8. A process cartridge according to claim 6 or 7, further comprising:

a rotary feed member for feeding the developer contained in said developer containing portion toward a side, on which said developing member is provided, being provided in said developer containing portion, wherein a flexible plastic sheet provided on said rotary feed member is brought into contact with said inside inclining surface portions formed on said first optical guide and said second optical guide each time said rotary feed member revolves.

9. A process cartridge according to claim 6 or 7, further comprising a viewing portion, through which a color of the developer contained in said developer containing portion can be viewed, being provided in one of said blocking portions.

10. A process cartridge according to claim 6 or 7, wherein an end portion of said optical guide portion of said second optical guide, the end portion being opposite to said end portion of said optical guide portion of said second optical guide on said blocking portion side of said second optical guide in a lengthwise direction of said optical guide portion of said second optical guide, has a convex shape.

11. A process cartridge according to claim 6 or 7, wherein said light-transmissive material is polystyrene.

12. A process cartridge according to claim 6 or 7, wherein said outside inclining surface portion of said first and second optical guides inclines substantially at an angle of about 45 degrees with respect to said blocking portion of said respective first and second optical guides.

13. An electrophotographic image forming apparatus to which a process cartridge is detachably mountable for forming an image on a recording medium, said apparatus comprising:

(a) a light-emitting member for emitting light;

(b) a light-receiving member for receiving the light;

(c) mounting means for mounting the process cartridge detachably, the process cartridge comprising:

(1) an electrophotographic photosensitive member;

(2) a developing member to be used for developing an electrostatic latent image formed on the electrophotographic photosensitive member;

(3) a developer containing portion for containing developer to be used for developing the electrostatic latent image by the developing member;

(4) a first optical guide formed into one united body with a light-transmissive material, said first optical guide including:

a blocking portion for blocking a first opening formed in the developer containing portion;

an optical guide portion for guiding the light emitted by said light-emitting member provided in the main body of said apparatus into the developer containing portion, the optical guide portion being formed on a side positioned on an outside of the developer containing portion with respect to the blocking portion;

an outside inclining surface portion inclining toward the side, on which the optical guide portion is formed, with respect to the blocking portion, the outside inclining surface portion being formed at an end portion of the optical guide portion on a blocking portion side in a lengthwise direction of the optical guide portion; and an inside inclining surface portion inclining toward a direction intersecting the lengthwise direction of the optical guide portion, the inside inclining surface portion being formed on a side to be positioned on an inside of the developer containing portion with respect to the blocking portion; and (5) a second optical guide formed into one united body with a light-transmissive material, said second optical guide including:

a blocking portion for blocking a second opening formed in the developer containing portion;

an optical guide portion for guiding the light that has passed through the developer containing portion to said light-receiving member provided on the main body of said apparatus, the optical guide portion being formed on a side positioned on the outside of the developer containing portion with respect to the blocking portion of the second optical guide;

an outside inclining surface portion inclining toward the side, on which the optical guide portion of the second optical guide is formed, with respect to the blocking portion of the second optical guide, the outside inclining surface portion being formed at an end portion of the optical guide portion of the second optical guide on a blocking portion side in a lengthwise direction of the optical guide portion of the second optical guide; and an inside inclining surface portion inclining toward a direction intersecting the lengthwise direction of the optical guide portion of the second optical guide, the inside inclining surface portion being formed on a side to be positioned on the inside of the developer containing portion with respect to the blocking portion of the second optical guide.

14. An electrophotographic image forming apparatus according to claim 13, wherein the outside inclining surface portions of the first and second optical guides incline substantially at an angle of about 45 degrees with respect to the blocking portion of the respective first and second optical guides.

* * * * *